US005167974A

United States Patent [19]

Grindrod et al.

[11] Patent Number: 5,167,974

[45] Date of Patent: Dec. 1, 1992

[54] VACUUM PACKAGING WITH HERMETIC RECLOSURE

[75] Inventors: Paul E. Grindrod, Madison; Ray H. Griesbach, Monona; Darrell G. Cornish, McFarland, all of Wis.

[73] Assignee: Oscar Mayer Foods Corporation, Madison, Wis.

[21] Appl. No.: 803,716

[22] Filed: Dec. 4, 1991

Related U.S. Application Data

[63] Continuation of Ser. No. 516,597, Apr. 30, 1990, abandoned, which is a continuation-in-part of Ser. No. 367,825, Jun. 19, 1989, abandoned, which is a continuation of Ser. No. 126,456, Nov. 30, 1987, Pat. No. 4,866,911.

[51] Int. Cl.[5] ..... B65B 31/02; B65D 81/20; B65D 17/00

[52] U.S. Cl. ..... 426/127; 426/106; 426/129; 426/126; 426/396; 426/415; 206/466; 229/123.1; 229/125.35; 156/152; 156/327

[58] Field of Search ..... 426/129, 130, 106, 122, 426/123, 126, 127, 396, 415; 220/359; 229/123.1, 125.35; 206/466

[56] References Cited

U.S. PATENT DOCUMENTS

| | | | |
|---|---|---|---|
| Re. 27,361 | 5/1972 | Miller | 206/633 |
| 3,131,069 | 4/1964 | Goller et al. | 426/129 |
| 3,228,168 | 1/1966 | Grindrod et al. | 426/415 |
| 3,229,810 | 1/1966 | Goller et al. | 426/129 |
| 3,330,670 | 7/1967 | Grindrod et al. | 426/129 |
| 3,343,661 | 9/1967 | Nugarus | 426/129 |
| 3,454,158 | 7/1969 | Tigner | 426/129 |
| 3,454,210 | 7/1969 | Speigel et al. | 206/633 |
| 3,515,270 | 6/1970 | Tonn et al. | 426/127 |
| 3,647,485 | 3/1972 | Seiferth et al. . | |
| 3,650,386 | 3/1972 | Tigner | 426/129 |
| 3,676,159 | 7/1972 | Fallowfield | 426/129 |
| 3,685,717 | 8/1972 | Seiferth et al. | 426/129 |
| 3,740,237 | 6/1973 | Grindrod et al. | 99/171 S |
| 3,836,679 | 9/1974 | Seiferth et al. | 426/126 |
| 4,215,797 | 8/1980 | Chen | 220/359 |
| 4,273,815 | 6/1981 | Gifford et al. | 426/129 |
| 4,411,122 | 10/1983 | Cornish et al. | 53/436 |
| 4,498,588 | 2/1985 | Scott | 206/526 |
| 4,498,589 | 2/1985 | Scott et al. | 206/526 |
| 4,500,021 | 2/1985 | Bildusas | 206/632 |
| 4,577,757 | 3/1986 | Hustad et al. | 206/461 |
| 4,786,190 | 11/1988 | Van Erden et al. | 206/632 |
| 4,823,961 | 4/1989 | Griesbach et al. | 426/129 |

OTHER PUBLICATIONS

Wiley Encyclopedia of Packaging Technology Bakker (Ed.) J. Wiley & Sons, 1986 p. 1.

Packaging Encyclopedia & Yearbook, vol. 30 #4, 1985 Cahners Publishing, p. 46.

*Food and Drug Packaging* article, "Tape strip reseals bags to keep tortillas fresh", Sep., 1987.

*Primary Examiner*—Steven Weinstein

*Attorney, Agent, or Firm*—Lockwood, Alex, Fitzgibbon & Cummings

[57] ABSTRACT

A package is provided for enclosing a proteinaceous product under vacuumized and hermetically sealed conditions. The package has a peelable hermetic reclosure and a body member of semi-rigid preformed plastic with a first planar marginal portion and a central portion shaped to provide a packaging chamber. The package also has a flexible dimensionally stable base member having a corresponding second planar marginal portion and a central portion to provide a closure for said packaging chamber. The two planar marginal portions are adhered together face-to-face by an adhesive to provide at least a portion of the hermetic seal wherein said adhesive is a high molecular weight pressure sensitive hot-melt adhesive having a viscosity of between about 5,000 and about 100,000 centipoise at 300° F. and said adhesive provides a peelable hermetic reclosure. Curling and wrinkling of the flexible base member are precluded by utilizing a flexible base member that is a film component, preferably a polyolefin film component, which has a coefficient of thermal expansion that is equal to or greater than that of the semi-rigid preformed plastic body member.

19 Claims, 2 Drawing Sheets

VACUUM PACKAGING WITH HERMETIC RECLOSURE

CROSS REFERENCE TO RELATED APPLICATIONS

This application is a continuation of application Ser. No. 07/516,597, filed Apr. 30, 1990, now abandoned, which is a continuation-in-part of application Ser. No. 367,825, filed Jun. 19, 1989, now abandoned, which is a continuation of application Ser. No. 126,456, filed Nov. 30, 1987, now U.S. Pat. No. 4,866,911.

FIELD OF THE INVENTION

This invention pertains to a vacuum packed package for a proteinaceous product and to a method of sealing same whereby a rigid thermoformed plastic body member is closed and sealed with a flexible plastic film having a surface coated with a high molecular weight pressure sensitive hot melt adhesive permitting easy peel opening and positive hermetic reclosure.

DESCRIPTION OF THE PRIOR ART

Vacuum packed packages for proteinaceous materials such as sliced luncheon meat are usually sealed by one of the following methods. In one method a heat seal fusion of a material to a similar material such as polyethylene to polyethylene, ethylene copolymer to ethylene copolymer or ionomer (Surlyn) to ionomer is used. This produces a fused seal which cannot be peeled open and must be cut or torn to open the package.

Another method produces a peelable heat seal by employing slightly dissimilar materials such as polyethylene to ethylene copolymers, ethylene copolymers to ionomers, polyethylene to polypropylene, low density polyethylene to medium density polyethylene and mixtures of these materials to slightly different mixtures. These seals are not resealable.

Still another method is to employ soft hot melt adhesive seals of similar or of different substrates such as Barex (acrylonitrile-methyl acrylate copolymer polymerized and/or mixed with butadiene as a terpolymer) to Barex, Barex to polyethylene, polyester to polyethylene, Saran to Barex, Saran to PVC, PVC to polyethylene and PVC to PVC. Seals are made by applying hot melt adhesive of relatively low viscosity (800 to 1800 centipoise at 300° F.) to one of the rigid plastic package components in an annular ring ⅛" wide and 5 mils thick at 300° F. and subsequently heat sealing the companion package component at 120° to 200° F. to the adhesive ring.

These hot-melt seals permit easy opening by peeling the package components apart. Opening is usually accompanied by a significant occurrence of cohesive failure by the adhesive; that is, the adhesive itself ruptures and exhibits a tendency toward stringing as the adhesive clings to diverging substrates. Cohesive failure and stringing occur because the internal cohesive strength of the soft, low molecular weight adhesive is less than the adhesive strength at the substrate/adhesive interface. These package components can be resealed, but resealing is complicated by stringing, displaced adhesive and warped, stretched package components. The customer perceives reclosure as potentially non-hermetic.

Descriptions indicating adhesives for providing sealed vacuum packaged products employing both rigid and flexible package parts can be found in U.S. Pat. Nos. 3,498,018, 3,647,485 to Seiferth et al; U.S. Pat. No. 3,740,237 to Grindrod et al; U.S. Pat. No. 3,836,679 to Seiferth et al; U.S. Pat. No. 4,411,122 to Cornish; U.S. Pat. Nos. 4,498,588 and 4,498,589 to Scott et al; and U.S. Pat. No. 4,577,757 to Hustad et al. Adhesives have also been used for packages other than vacuum packages. For instance, adhesives are disclosed with a reusable plastic container in U.S. Pat. No. 4,215,797 to Chen.

In the aforementioned methods and patents, high molecular weight pressure sensitive hot melt adhesives are not specified, and it has been the practice to employ relatively low viscosity hot melts with the aforementioned disadvantages.

It is believed that high molecular weight pressure sensitive hot melt adhesives have been used as a reclosure for food packages. However, these packages are not vacuum packed nor do they contain a rigid component. An example of such a package is described in *Food and Drug Packaging*, September, 1987, page 18, under the article entitled, "Tape Strip Reseals Bags to Keep Tortillas Fresh." According to this article, pressure sensitive tape with adhesive on both sides is used to reseal a food package. The pressure sensitive tape, it is believed, is made of a high molecular weight pressure sensitive hot-melt adhesive. However, since a tape is employed rather than an adhesive put directly onto the package, the tape is not suitable for vacuum sealing the package. Also, the food product mentioned in this article is not vacuum sealed.

BRIEF DESCRIPTION OF THE DRAWINGS

The Figures are schematic views showing vacuumized hermetically sealed packages with a peelable hermetic reclosure.

SUMMARY OF THE INVENTION

Figure 1:
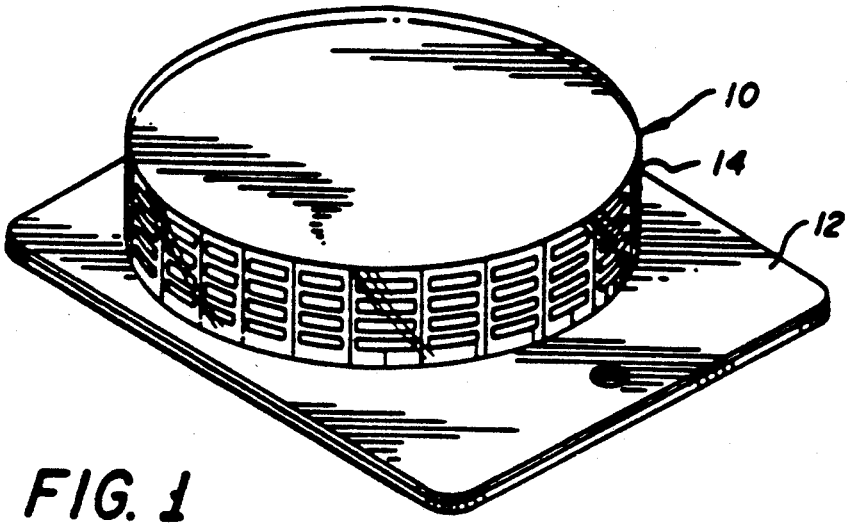
FIG. 1 is a perspective view of a typical package incorporating the invention.
Figure 2:
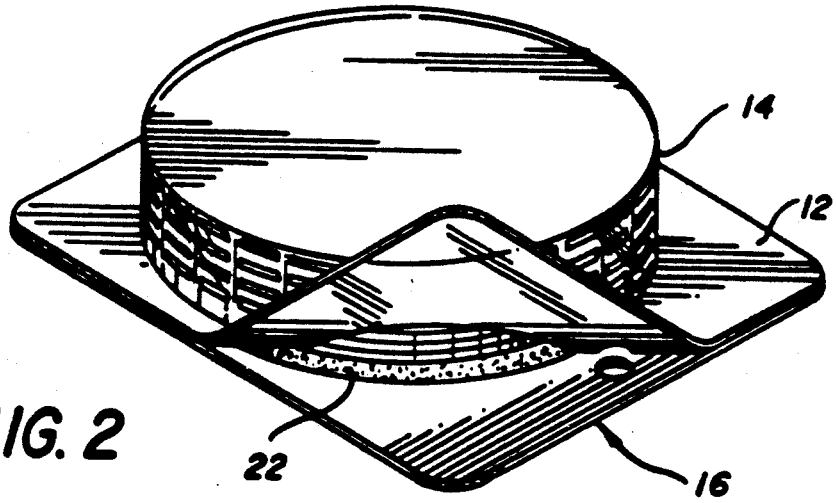
FIG. 2 is a perspective view of the package shown in FIG. 1, with a corner thereof being peeled back.
Figure 3:
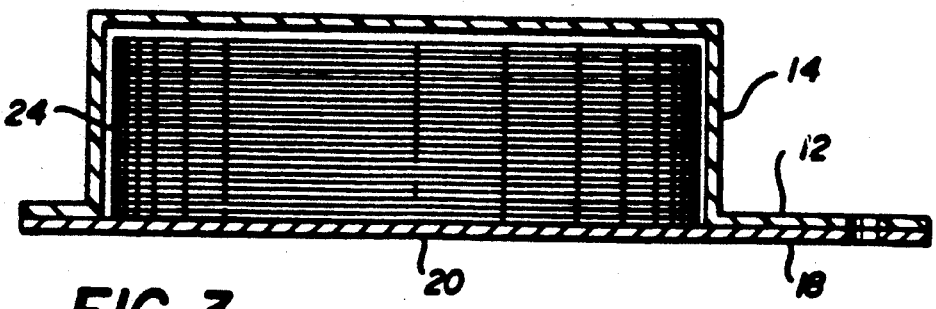
FIG. 3 is a longitudinal cross-sectional view of the package shown in FIGS. 1 and 2.
Figure 4:
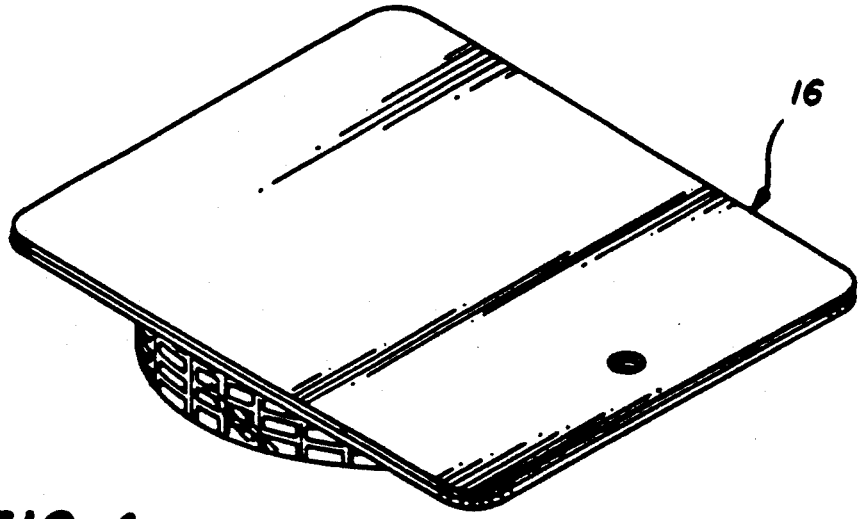
FIG. 4 is a bottom perspective view of another embodiment of a typical package incorporating the invention.
Figure 5:
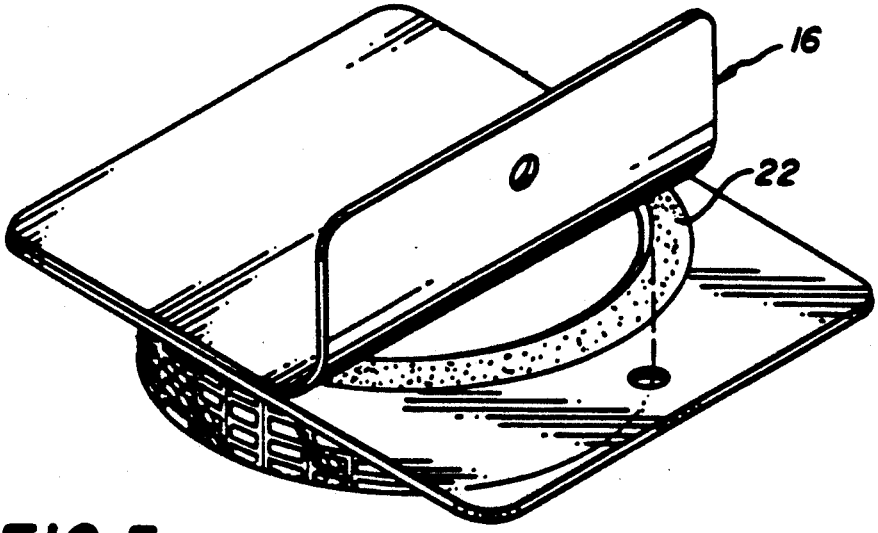
FIG. 5 is a perspective view of the package shown in FIG. 4, with a portion thereof being peeled back.
Figure 6:
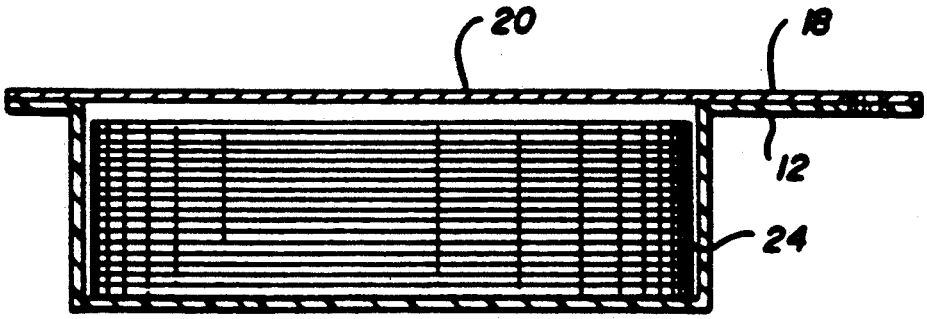
FIG. 6 is a longitudinal cross-sectional view of the package shown in FIGS. 4 and 5.

This invention pertains to a package and a continuous method of enclosing a proteinaceous product in a vacuumized and hermetically sealed package having a peelable hermetic reclosure. The package has a body member of semi-rigid preform plastic with a first planar marginal portion and a central portion shaped to provide a packaging chamber. The package also has a flexible dimensionally stable base having a corresponding second planar marginal portion and a central portion to provide a closure for said packaging chamber. The method includes placing a sufficient quantity of a proteinaceous product in the central portion of the body member to substantially fill the central portion when the package is completed. The first planar marginal portion is positioned face-to-face to the corresponding second planar marginal portion. The assembly is vacuumized and hermetically sealed. An adhesive is applied to either the first planar marginal portion or the corresponding second planar marginal portion to provide at least a portion of the hermetic seal, and the adhesive is a high molecular weight pressure sensitive hot melt adhesive having a viscosity of between about 5,000 and 100,000 centipoise at 300° F. which cooperates with the flexible base to provide a peelable hermetic reclosure. It has been found that when this invention is employed, the adhesive permits the use of a stronger adhesive which can still be opened without excessive force. It further provides through the use of a rigidly formed container adhered to a flexible film a positive reclosure perceived to the customer because the cohesively strong adhesive makes an undisturbed surface for easily rolling the film back into a reclosed position and because problems such as curling and wrinkling of the film are closely controlled.

DETAILED DESCRIPTION OF THE INVENTION

This invention pertains to a package and method of enclosing a proteinaceous product. Proteinaceous products are meant to include all meat products, such as beef, pork, poultry, fish and products with meat mixtures and other proteinaceous products, such as cheese. Typically these products are of the sliced luncheon meat variety.

Referring to the Figures, a body member 10 having a first planar portion 12 and a central portion 14 to provide a packaging chamber is shown. The central portion may be of any suitable cross-sectional shape such as round, square or oval. Suitable materials for making the semi-rigid preform plastic body are Barex, polystyrene, polyester and PVC. Suitably these bodies are thermoformed from sheets of about 10 to about 15 mils in thickness.

A flexible, dimensionally stable base member 16 is also provided. By dimensionally stable, it is meant a base member having sufficient structural integrity such that, when the package is opened, the opening forces do not distort the flexible base member from its original length/width of original shape. The base member has a corresponding second planar marginal portion 18 and a central portion 20 to provide a closure for the packaging chamber 14. The flexible material out of which the base member 16 is constructed has a higher coefficient of thermal expansion than that of the thermoformed body member 10 package component to which it is adhered by the high molecular weight pressure sensitive adhesive.

The high molecular weight pressure sensitive hot-melt adhesive is applied to either the first planar margin portion 12 or the corresponding second planar margin portion 18. The pressure sensitive adhesive melt may be applied totally around the closure as shown by 22 or may be partially applied around the closure and used in conjunction with a low molecular weight pressure sensitive hot-melt adhesive or other sealing method to complete the closure.

By high molecular weight pressure sensitive hot-melt adhesive it is meant an adhesive having a viscosity of between about 5,000 and about 100,000 centipoise at 300° F. and preferably between about 5,500 and about 50,000 centipoise at 300° F. When these adhesives are applied to the body member or base member, care must be taken to avoid damaging the packaging materials since these melts are applied at high temperatures. It has been found that when metal-coated or metallized films are employed, the high molecular weight adhesives can be applied directly to the film without distorting them. However, when other materials such as Barex are employed, the high molecular weight adhesive cannot be applied directly to the Barex at high temperatures since it deforms the material. A suitable means of applying the adhesive to such a material is to first apply the high molecular weight adhesive to a sheet of silicone rubber in the desired pattern. The adhesive after cooling may then be transferred from the silicone film to the Barex. Suitable adhesives are Fuller 2703 (12,000 centipoise at 300° F.) available from the H.B. Fuller Company at St. Paul, Minn. or National 5256-43-12 (5,700 centipoise at 300° F.) available from the National Starch and Chemical Corporation of Ridgewater, N.J. Suitably the adhesives are applied at about 1 to 10 mils in thickness and in a pattern of about ⅛" to 1" wide.

In order to prepare the package the body members are filled with a suitable amount of material 24 to substantially fill the central portion of the body member so that when the package is completed the central portion is completely filled. The packages may be filled either singly or may be done in a multiple array such as by filling an array of eight or ten packages. After the proteinaceous product has been filled into the central portion, the base members are aligned with the body members such that the corresponding second planar marginal portion is face-to-face with the first planar marginal portion. A closure machine is employed wherein it is vacuumized suitably to a vacuum of approximately 29.8 inches of mercury, and a heated plate is employed to actuate the adhesive and seal the coating film together. The heated plate operation usually is at 100° to 200° F. After the hermetic seal has been applied the vacuum is released and the chamber opened. If a multiple array of packages have been produced, the packages are cut into the desired size.

With more particular reference to the flexible component of the packages in accordance with this invention such as the flexible, dimensionally stable base member 16, these are non-forming films or lidding films which are either monolithic or of a symmetrical lamination construction. It has been determined that these materials should have a higher coefficient of thermal expansion than the thermoformed package component to which it is adhered. It has been found that some often-used non-forming films and lidding films are not suitable for forming the peelable/resealable packages according to the present invention. The peelable/resealable package must be designed in its entirety to circumvent the intense forces induced by temperature change between the package components. Such forces can lead to unsatisfactory packages which exhibit temperature-induced curling, or they can lead to failure because of the onset of wrinkling after sealing and as the package is cooled.

Generally speaking, it is not possible to make a suitable package with a high molecular weight adhesive by simply substituting same for a softer, more pliable, pressure-sensitive hot-melt adhesive of the type that has been used in known peelable/resealable packages. Typically, these known packages utilize non-forming films and lidding films which do not exhibit properties that are needed for avoiding curling or wrinkling problems. It has been found that films which have a relatively high coefficient of thermal expansion, when used in making packages of the type discussed herein, do not exhibit these types of problems. Polyolefin films typically have a relatively high coefficient of thermal expansion and have a high shrink rate when cooled. Either monolithic or laminated polyolefin films are suitable. Examples include monolithic oriented polypropylene films and a symmetrical lamination of oriented polypropylene film on both sides of polyethylene film. For enhancing the gas barrier properties of the film, it is generally preferred that the films include a coating of polyvinylidene chloride. Typically such coatings are less than 0.10 mil thick, and they do not significantly affect the physical characteristics of the flexible film.

COMPARATIVE EXAMPLE A

A package was produced which included a Barex body member and a flexible, dimensionally stable base member which was a lamination of oriented polyester that was Saran coated and laminated to a 2 mil film of polyethylene or Surlyn. This film lamination is a commonly used non-forming film which is used on various commercial machines for heat sealing to thermoformed package components. The body member and this flexible film base member were adhered together by a high molecular weight pressure sensitive hot-melt adhesive as described herein. Packages were made with the oriented polyester or with the polyolefin side of the flexible film sealed against the thermoformed rigid package component.

Failures were exhibited by these packages in that the flexible film slowly curled off the bubble or body member. When the flexible film was sealed with the polyolefin side toward the adhesive/body member interface, the flexible film curled inwardly and rolled up much like a window shade does. When the flexible film was sealed with the oriented polyester toward the adhesive/body member interface, the flexible film peeled outwardly and rolled away from the base. These types of failures were not observed with packages substantially the same as these, but wherein a soft, low molecular weight hot-melt adhesive was used in place of the high molecular weight adhesive. It is believed that the soft, low molecular weight adhesive has the ability to reshape itself in accordance with the stresses upon it by dimensional changes in the flexible film to thereby absorb and redistribute the stress over a larger area, thus preventing curling and peeling away of the flexible film from the surface of the rigid body member.

Because of the asymmetric nature of the flexible film used in this example, and particularly because the different films have divergent coefficients of thermal expansion, the curling problem is quite apparent. Packages of the type discussed herein are intended to be distributed and used under conditions in which they are subjected to somewhat wide temperature variations, and an asymmetric film of this type is believed to exhibit back and forth oscillation which tugs at the pressure-sensitive adhesive peel seal. This is believed to contribute to the pulling away and curling that was experienced with these packages.

COMPARATIVE EXAMPLE B

Other packages were made similar to those of comparative Example A, except the flexible film used was a monofilm or symmetrical film, namely a widely used lidding stock film of ½ mil Saran-coated oriented polyester film. The thus formed peelable/resealable packages exhibited failures because the flexible film spontaneously generated wrinkles in itself as the package equilibrated to refrigeration temperatures after vacuum sealing. A myriad of wrinkles were formed, which generated capillary openings that destroyed package hermeticity. Although this film was monolithic, it still did not provide a commercially satisfactory package.

It is suggested that the wrinkling problem experienced in this Example can be explained because of the difference in the respective thermal expansion coefficients of the two films. The coefficient of thermal expansion of oriented polyester is about $51\times10^{-6}$ in/in°C. which is somewhat less than that of a rigid PVC bubble or tray or a rigid Barex (acrylonitrile copolymer) bubble or tray ($66\times10^{-6}$ in/in°C.). When the hot-melt, high molecular weight pressure sensitive adhesive interface is activated with a heated platen during assembly, the PVC or Barex bubble or tray expands to a greater extent than does the polyester film. When the adhesive interface begins to cool, the flexible film is locked onto the surface of the rigid bubble or tray, and as the assembly of Barex, high molecular weight adhesive, and flexible thermoplastic polyester film equilibrates to refrigeration temperatures, the Barex, having a higher coefficient of thermal expansion, shrinks more than does the polyester film. This shrinkage is believed to impose an acute stress on the polyester, which in effect is larger in area than the Barex. The high molecular weight adhesive locks tightly onto the polyester, permitting no shear or sliding between the Barex and the polyester film. As the stress exceeds the strength of the seal at the adhesive/polyester interface, the polyester film buckles and generates a wrinkle which destroys package hermeticity.

EXAMPLE I

Packages similar to those of comparative Examples A and B were made, except the flexible film was a monolithic oriented polypropylene having a coefficient of thermal expansion range of from 80 to $100\times10^{-6}$ in/in/°C. The hot-melt, high molecular weight pressure sensitive adhesive interface was activated with a heated platen, and the adhesive interface was cooled to refrigeration temperatures, the flexible film having a relatively high shrink rate during cooling. The package remained sealed, smooth and free of any developing wrinkles, even after extended storage in a refrigerated showcase having fluctuating temperatures. The polypropylene flexible film was found to be especially useful because of its ability to be oriented to provide good dimensional stability. The particular polypropylene film used incorporated a 0.1 mil coating of Saran in order to improve the barrier properties of the film.

It is believed that the polyolefin dimensionally stable films such as the oriented polypropylene film of this Example generate the sharply intensified stress at the peel interface which is necessary to make the package openable at a seal strength level required to maintain package integrity. Because the film of this Example was not asymmetrical, stresses were not developed due to differences in thermal expansion coefficients of the components of the film. The Example further illustrates that, although a high molecular weight hot-melt adhesive was used which fails to stretch at the interface, the combination of films and adhesive according to this Example avoids the curling or wrinkling problems which develop by structures such as those in comparative Examples A and B which do not alleviate stress intensification that develops, particularly upon storage cooling. This Example illustrates that such stress intensification is not experienced by the package of this Example.

EXAMPLE II

A package in accordance with Example I was constructed, except the flexible polyolefin film was a laminate of polyolefin films, namely a symmetrical lamination of oriented polypropylene film on both sides of a polyethylene film. Polyethylene film has a coefficient of thermal expansion of between 100 and $200\times10^{-6}$ in/in/°C. This flexible film was coated with less than 0.1 mil of Saran coating in order to enhance the gas barrier properties of the film. It was observed that packages made according to this Example remained smooth and free of wrinkle development, even after extended storage in a fluctuating temperature showcase.

Examples I and II illustrate that a satisfactory package can be prepared even when using a high molecular weight hot-melt adhesive that provides a peelable seal interface. Because of the peelability of peel seal adhesives, stresses at the adherence joint will tend to initiate peeling. It is believed that the packages of Examples I and II minimized the development of stresses, with the result that the seal did not peel within the normal life of the package. Packages such as those of comparative Examples A and B are believed to have exhibited higher stresses, as indicated by the spontaneous peeling of the peel seal and consequent package failure in form of curling or wrinkling at the adhesive interface.

It will be understood that the embodiments of the invention which have been described are illustrative of some of the applications of the principles of the present invention. Modifications may be made by those skilled in the art without departing from the true spirit and scope of the invention.

We claim:

1. In a vacuumized and hermetically sealed package having a peelable hermetic reclosure and having a body member of semi-rigid self-supporting plastic with a first planar marginal portion and a central portion shaped to provide a packaging chamber, a flexible dimensionally stable base member panel having a corresponding second planar marginal portion and a central portion to provide a closure for said packaging chamber, the package prepared by placing a sufficient quantity of a proteinaceous product in the central portion of the body member to substantially fill the central portion when the package is completed, positioning the first planar marginal portion face-to-face to the corresponding second planar marginal portion, vacuumizing the assembly, and hermetically sealing the package, the improvement comprising applying prior to sealing an adhesive to either the first or the second planar marginal portion to provide at least a portion of the hermetic seal wherein said adhesive is a high molecular weight pressure sensitive hot-melt adhesive having a viscosity of between about 5,000 and about 100,000 centipoise at 300° F. and said adhesive provides a peelable, resealable hermetic reclosure, wherein said flexible dimensionally stable base member panel is a plastic film component having a coefficient of thermal expansion which is greater than that of said semi-rigid plastic body member, and wherein said flexible base member film component panel adhered to said semi-rigid body member through said high molecular weight pressure sensitive hot-melt adhesive remains so adhered and precludes the onset of curling of said flexible panel away from and wrinkling of said flexible panel with respect to the semi-rigid body member upon having been subjected to heating to activate the hot-melt adhesive followed by cooling and storage under refrigeration conditions for the proteinaceous product.

2. The package according to claim 1, wherein said flexible dimensionally stable base member is a polyolefin film component.

3. The package according to claim 1, wherein said flexible dimensionally stable base member is a polypropylene film component.

4. The package according to claim 1, wherein said flexible dimensionally stable base member is a polyethylene film component.

5. The package according to claim 1, wherein said flexible dimensionally stable base member is a symmetrical laminate of a polyethylene film and a polypropylene film.

6. The package according to claim 1, wherein said flexible dimensionally stable base member is an oriented polyolefin film component.

7. The package according to claim 1, wherein said flexible dimensionally stable base member is a monolithic oriented polypropylene sheet.

8. The package according to claim 1, wherein said flexible dimensionally stable base member is a polyolefin film component coated with a gas-barrier polymer.

9. The package according to claim 1, wherein the coefficient of thermal expansion of said flexible film component is at least about $70\times10^{-6}$ in/in/°C.

10. The package according to claim 1, wherein the coefficient of thermal expansion of said flexible film component is at least about $80\times10^{-6}$ in/in/°C.

11. A package according to claim 1 wherein the high molecular weight pressure sensitive hot-melt adhesive has a viscosity of between about 5,500 and about 50,000 centipoise at 300° F.

12. The package according to claim 1, wherein said flexible dimensionally stable base member panel is a film component which is a monolithic polyolefin film component or a symmetrical lamination of different polyolefin films.

13. The package according to claim 12, wherein said polyolefins are polypropylene or polyethylene.

14. A vacuum packaged and hermetically sealed meat product, comprising a vacuumized and hermetically sealed package having a body member of self-supporting plastic, said body member having a planar marginal portion and a central portion shaped to provide a packaging chamber, a meat product within and substantially filling said packaging chamber, a flexible base member panel having a planar marginal portion generally corresponding to said planar marginal portion of the body member, said flexible base member panel further having a central portion which provides a closure for said packaging chamber, said respective planar marginal portions are in face-to-face relationship with each other with an adhesive therebetween to provide at least a portion of the hermetic seal of the vacuumized package, said adhesive is a high molecular weight pressure sensitive hot-melt adhesive having a viscosity of between about 5,000 and about 100,000 centipoise at 300° F. and said adhesive provides a peelable, resealable hermetic reclosure, wherein said flexible base member panel is a plastic film component having a coefficient of thermal expansion which is greater than that of said semi-rigid plastic body member, and wherein said flexible base member film component panel adhered to said semi-rigid body member through said high molecular weight pressure sensitive hot-melt adhesive remains so adhered and precludes the onset of curling away of said flexible panel from and wrinkling of said flexible panel with respect to the semi-rigid body member upon having been subjected to heating to activate the hot-melt adhesive followed by cooling and storage under refrigeration conditions for the proteinaceous product.

15. The packaged meat product according to claim 14, wherein said meat product includes a plurality of slices of luncheon meat.

16. The packaged meat product according to claim 14, wherein said flexible base member is a polyolefin film component selected from the group consisting of polypropylene film, polyethylene film, a symmetrical laminate of polyethylene film and polypropylene film, an oriented polyolefin film, a monolithic oriented polypropylene sheet, and a polyolefin film coated with a gas-barrier polymer.

17. The packaged meat product according to claim 14, wherein the coefficient of thermal expansion of said flexible film component is at least about $70\times10^{-6}$ in-/in°C.

18. The packaged meat product according to claim 14, wherein the coefficient of thermal expansion of said flexible film component is at least about $80\times10^{-6}$in-/in°C.

19. The packaged meat product according to claim 14, wherein said flexible base member panel is a film component which is a monolithic polyolefin film component or a symmetrical lamination of different polyolefin films.

* * * * *